US010036228B2

(12) United States Patent
Coronado

(10) Patent No.: US 10,036,228 B2
(45) Date of Patent: Jul. 31, 2018

(54) HYDRAULIC CEMENTING PORT COLLAR WITH INTEGRAL SWIVEL-SPLINE FEATURE

(71) Applicant: HydraWell Inc., Houston, TX (US)

(72) Inventor: Martin P. Coronado, Cypress, TX (US)

(73) Assignee: HydraWell Inc., Houston, TX (US)

( * ) Notice: Subject to any disclaimer, the term of this patent is extended or adjusted under 35 U.S.C. 154(b) by 324 days.

(21) Appl. No.: 14/719,944

(22) Filed: May 22, 2015

(65) Prior Publication Data

US 2016/0024877 A1 Jan. 28, 2016

Related U.S. Application Data

(60) Provisional application No. 62/001,938, filed on May 22, 2014.

(51) Int. Cl.
*E21B 33/14* (2006.01)
*E21B 33/16* (2006.01)
*E21B 34/10* (2006.01)

(52) U.S. Cl.
CPC ..... *E21B 33/146* (2013.01); *E21B 33/16* (2013.01); *E21B 34/10* (2013.01)

(58) Field of Classification Search
CPC ..... E21B 33/146; E21B 33/16; E21B 34/10
See application file for complete search history.

(56) References Cited

U.S. PATENT DOCUMENTS

| | | | |
|---|---|---|---|
| 4,693,314 | A | 9/1987 | Wesson et al. |
| 5,048,611 | A | 9/1991 | Cochran |
| 5,358,048 | A | 10/1994 | Brooks |
| 6,241,018 | B1 | 6/2001 | Eriksen |
| 2007/0246217 | A1 | 10/2007 | Tulloch et al. |
| 2012/0247767 | A1 | 10/2012 | Themig et al. |

FOREIGN PATENT DOCUMENTS

WO 2015179766 A1 11/2015

OTHER PUBLICATIONS

PCT/US2015/032183, International Search Report dated Aug. 18, 2015, 2 pages.
PCT/US2015/032183, Written Opinion dated Aug. 18, 2015, 5 pages.
PCT/US2015/032183, International Preliminary Report on Patentability, dated Nov. 22, 2016, 7 pages.

*Primary Examiner* — Caroline N Butcher
(74) *Attorney, Agent, or Firm* — Wick Phillips Gould & Martin LLP

(57) ABSTRACT

Embodiments relate to methods and devices for improved liner drill-in operations. Specifically, embodiments may provide the capability to selectively allow rotation of the liner, even once a packer has been set. Typical embodiments might couple a port sealing collar (that can selectively seal or open a port in the liner) to a selectively lockable swivel joint, for example.

18 Claims, 8 Drawing Sheets

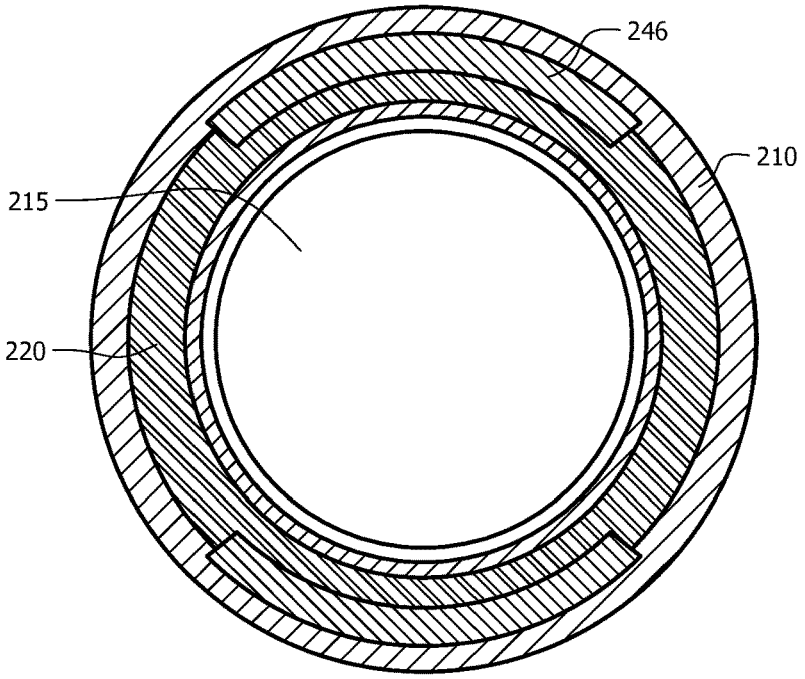
*FIG. 2A1*
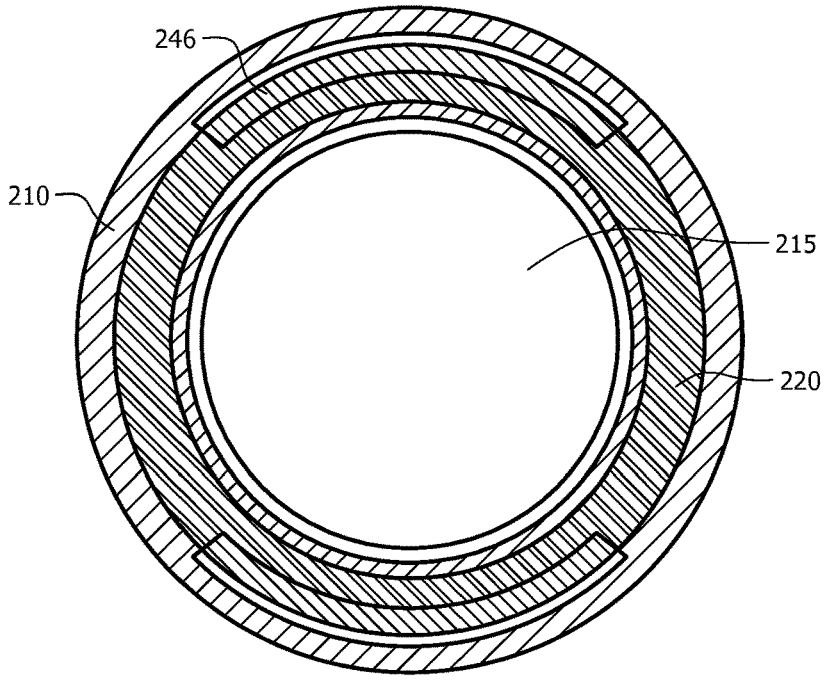
*FIG. 2B1*

HYDRAULIC CEMENTING PORT COLLAR WITH INTEGRAL SWIVEL-SPLINE FEATURE

CROSS-REFERENCE TO RELATED APPLICATIONS

This application is a non-provisional of and claims benefit under 35 U.S.C. § 119 to U.S. Provisional Patent Application Ser. No. 62/001,938, filed on May 22, 2014, and entitled "Hydraulic Cementing Port Collar with Integral Swivel/Spline Feature", which is hereby incorporated by reference for all purposes as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

During well formation/drilling, operators sometime use liner drill-in techniques to save valuable rig time. Typically, in liner drill-in operations a drill bit is placed on the end of the liner (in a tool string), so that the liner can actually be used to drill the well. This may allow drilling of the hole and placing of the liner in a single operation. And typically, once the liner has been placed downhole, it would then be cemented in place.

While such conventional liner drill-in operations might allow for drilling and liner placement in a single operation, they unfortunately have limitations that make their use impractical in some instances/circumstances. For example, oftentimes packer isolation (in which an open hole packer is placed in the annular space between the liner and the sidewalls of the hole) is required prior to cementing operations, in order to prevent cement losses to the formation below (which might for example, be a low-pressure reservoir). Additionally, rotation of the liner during cementing of the liner in place in the hole may provide higher quality cement coverage in the liner-to-open hole annulus (such that rotation of the liner during cementing can prove beneficial in effectively placing the liner downhole). Unfortunately such rotation of the liner may not be possible in conventional liner drill-in operations, since the packer would prevent free rotation of the liner during cementing. In other words, conventional liner drill-in operations may be unavailable (due to technical and functional limitations) in certain instances, for example when an open hole packer is required to be set against the drilled formation hole, thereby preventing rotation of the liner for improved cementing (since the lower section of the liner would then be coupled to the hole sidewalls).

Disclosed embodiments provide for improved liner drill-in operations, by providing a tool that may be rotationally locked during drilling, but which can be unlocked to allow rotation of the liner above the packer during cementing. These and other improvements are discussed below in more detail.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
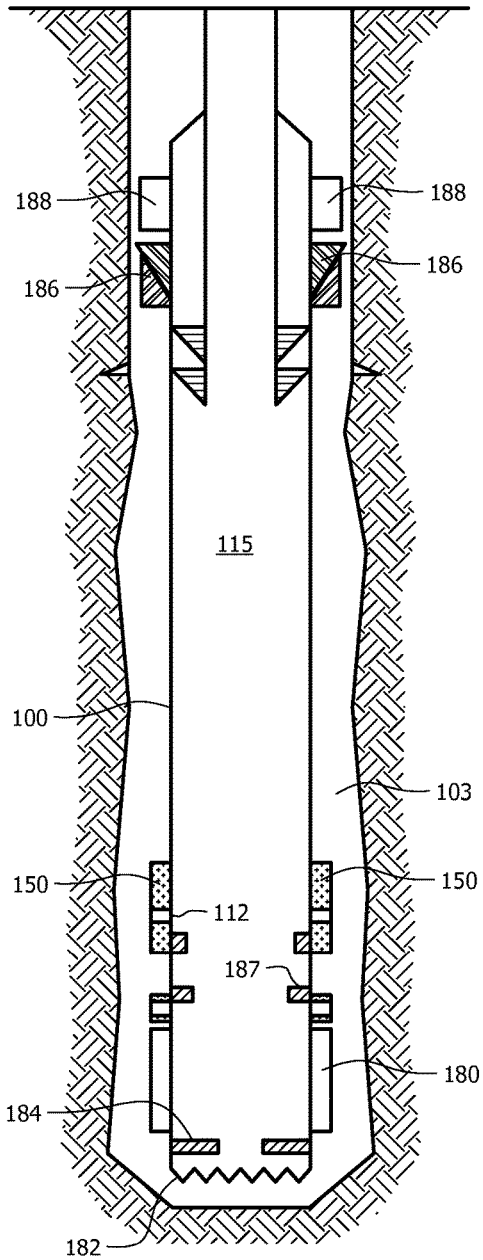
FIGS. 1A-H illustrate schematically a downhole operation (for example in a well) allowing for liner drill-in and cementing (even when the lower section of the liner is not able to rotate due to an open hole packer having been set against the drilled hole/formation bore)

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "up", "uphole", "above", or the like, when used in reference to the well or the tool string for example, shall mean towards the surface or towards the top; similarly, the term "down", "downhole", "below", or the like shall mean away from the surface or towards the bottom;

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or approximately" or the like, when used with a number, may mean that specific number, or alternatively, a range in proximity to the specific number, as understood by persons of skill in the art field (for example, +/−10%); and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments may relate generally to a drilling port collar tool (for interaction with a port in the liner, to close or open the port, for example during cementing), of the type that might be used for liner drill-in operations. Specifically, embodiments may relate to such a tool for use when packer isolation may be required prior to cementing operations (for example, to prevent cement losses to the formation below), especially when rotation of the tool is desirable during cementing. Thus, embodiments typically would allow torque transmission during the drilling operation, but would allow for rotation of the liner (for example, by providing a rotation point) during cementing operations. Consequently, disclosed embodiments typically provide a rotation point in the liner for cementing operations, which may be torsionally/rotationally locked during drilling operations (to allow torque transmission to the drill bit as the tool string is rotated during drilling).

Typically, the tool would be rotationally locked during drilling operations (so that the liner and/or tool string can act as a solid element in rotation that transmits torque down to the drill bit attached to the bottom of the liner for drilling of the hole). Once the hole is drilled and the liner is in position, the liner would typically be cemented in position before the next section of the hole would be drilled. If an under-pressured reservoir is located below the liner, an open hole packer might need to be used to isolate the reservoir from the annulus of the hole (between the liner and the hole sidewalls) prior to cementing (for example, to prevent cement from entering the formation below the liner). Once the packer is set, it will essentially lock/hold the position of the lower portion of the liner (since the liner will be held snug at that location by action of the packer pressing between the liner and the sidewalls of the hole, coupling the liner to the hole). But as discussed above, it may be advantageous during cementing to rotate the liner (to provide higher quality cement coverage in the annulus). Unfortunately, the packer may complicate such rotation during cementing. So to allow for rotation of the liner during cementing despite the presence of a packer, the disclosed tool embodiments might be used.

Specifically, activation of the port collar element may simultaneously allow hydraulic/fluid communication between the bore of the liner and the open hole annulus (so that cement pumped down the liner's bore might then flow outward through a port the liner into the annulus area between the liner and the sidewalls of the hole), while also disengaging the torsional/rotational lock (thereby allowing the upper portion of the tool string to rotate (for example during cementing operation) despite the lower portion of the tool being held by the packer). Once the cementing operation has been completed, the port collar element may be sealed/closed (to block the port and prevent further fluid communication from the longitudinal bore of the tool to the annulus). Typically, the tool may be operated hydraulically based on pressure within the bore of the liner (although in other embodiments, one or more portions of the tool might be operated using alternative means).

Figure 1B:
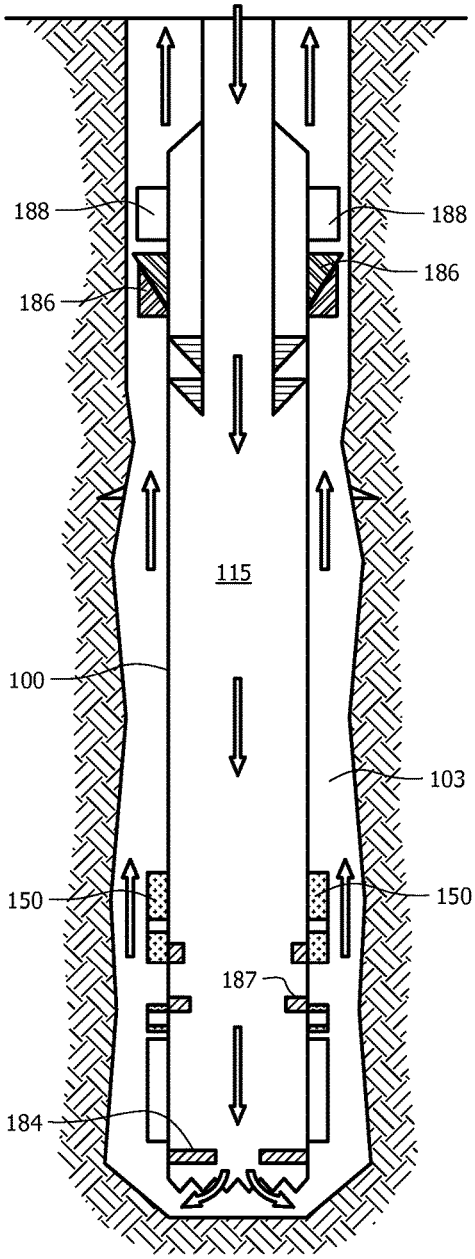
Figure 1C:
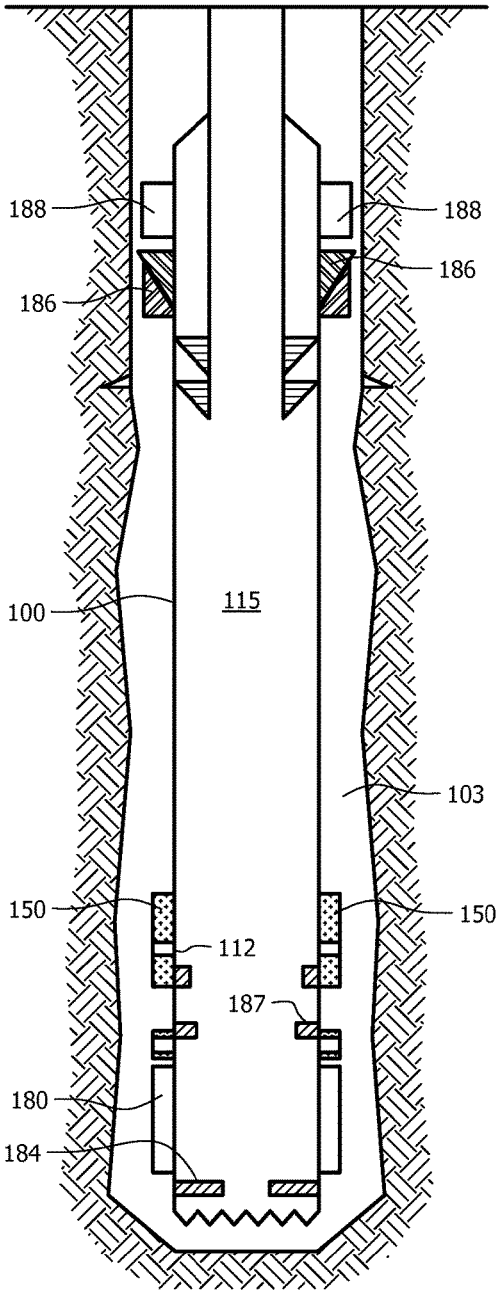
Figure 1D:
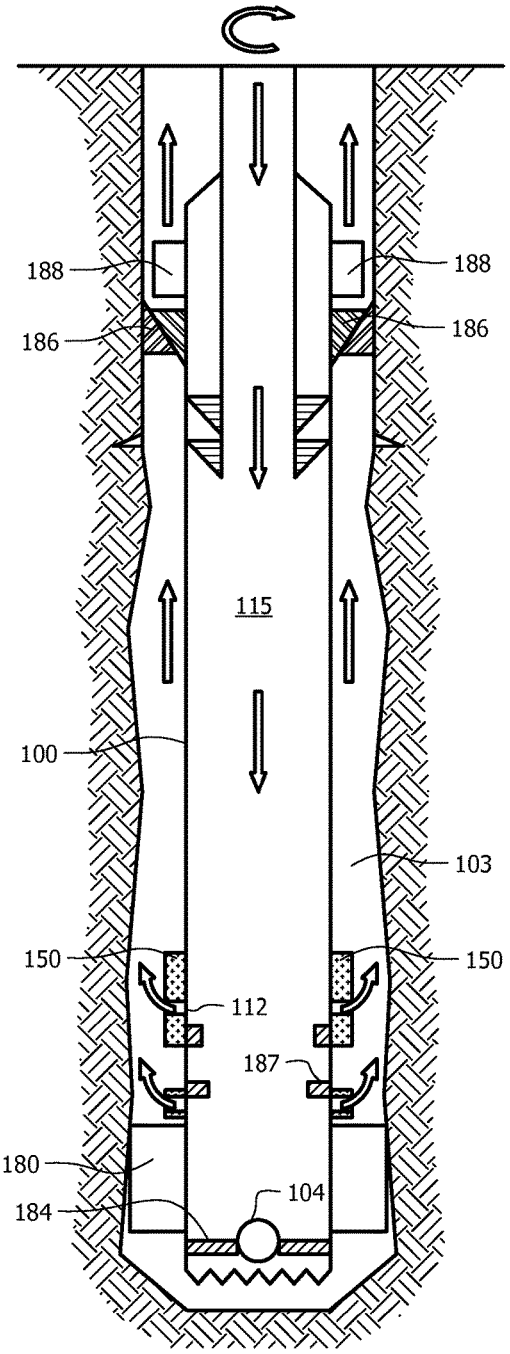
Figure 1E:
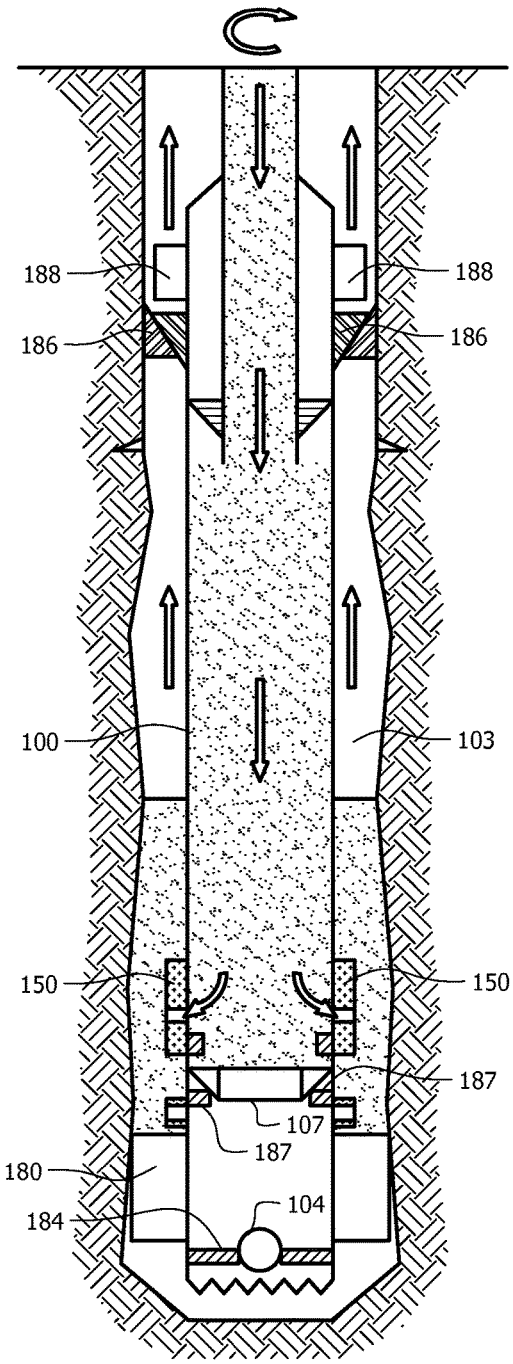

FIGS. 1A-H illustrate an exemplary process for using such a port collar tool during liner drill-in and cementing operations. FIG. 1A illustrates exemplary elements of a tool string embodiment (including the liner 100 with port collar 150 having a selectable swivel) which might be used during such an exemplary downhole operation. The liner 100 typically might have an open hole packer 180 affixed to its exterior near its bottom and a port collar/swivel 150 (for interaction with a port 112 in the liner 100 and selective rotational locking). First, in FIG. 1B a liner 100 (which is attached to the end of a tool string and has a drill bit 182 attached to its lower end) would be drilled into place. Mud typically would be circulated down the bore 115 of the tool string (including the liner 100), through the end of the drilling shoe bit, and back up the annulus 103 (e.g. annular space between the liner and the hole sidewalls), as shown in FIG. 1B. In FIG. 1B, the port collar/swivel 150 would be closed (preventing fluid flow out through the port 112 in the liner) and the spline joint would be engaged (preventing rotation and allowing torque to be transmitted to the drill bit for drilling). In FIG. 1C, the liner 100 has been drilled to its final/total depth (e.g. it is located longitudinally/depthwise in the hole at the location at which it will be fixed via cement), so there is no more mud being pumped down the bore 115. In FIG. 1C, however, the tool string configuration has not yet been changed from drilling to cementing. Then, in FIG. 1D a ball 104 might be dropped/pumped down the bore 115 to seal the bore of the liner at or near its bottom (for example, by engaging in a sealing manner with a ball seat 184 below the position of the open hole packer 180 on the liner). Once the ball 104 has been dropped, applied pressure in the bore 115 might set the liner hanger 186 (e.g. a rotating type of liner hanger), activate the open hole packer 180 to seal the annular space between the liner 100 and the sidewalls of the hole towards the bottom of the liner), and hydraulically activate the port collar/swivel 150 (to open the port 112 in the liner to allow flow from the bore 115 to the annulus 103 and to disengage the spline joint (e.g. unlock the swivel) to allow swivel/rotation). Thus, the process of FIG. 1D may allow the liner 100 above the port collar 150 to be rotated. Then optionally in FIG. 1D, mud might be circulated (down the bore 115, through the port 112, into the annulus 103) while rotating the liner 100 prior to cementing, to condition the hole. FIG. 1E then shows optional hydraulic placement of a lead pump down plug 107 in a corresponding plug seat 187 (to seal the bore 115 just below the port collar/swivel 150), and the circulation of cement down the bore 115, through the open port 112 into the annulus 103, while rotating the liner. Typically, the lead pump down plug might land in a lead liner wiper plug, which would then shear loose until the lead wiper plug lands in the plug seat.

Figure 1F:
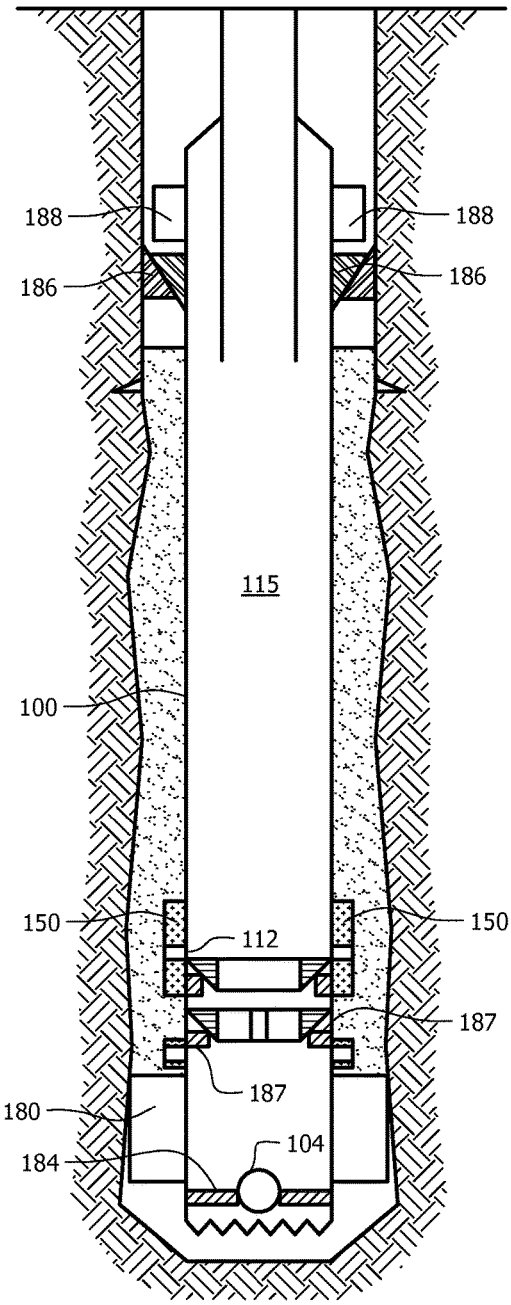
Figure 1G:
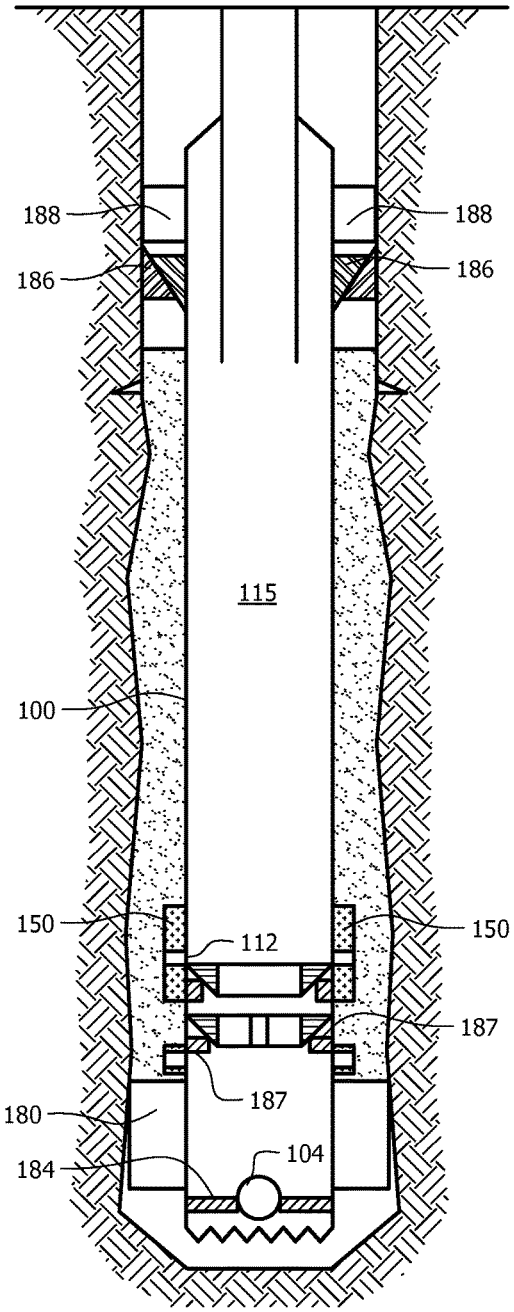
Figure 1H:
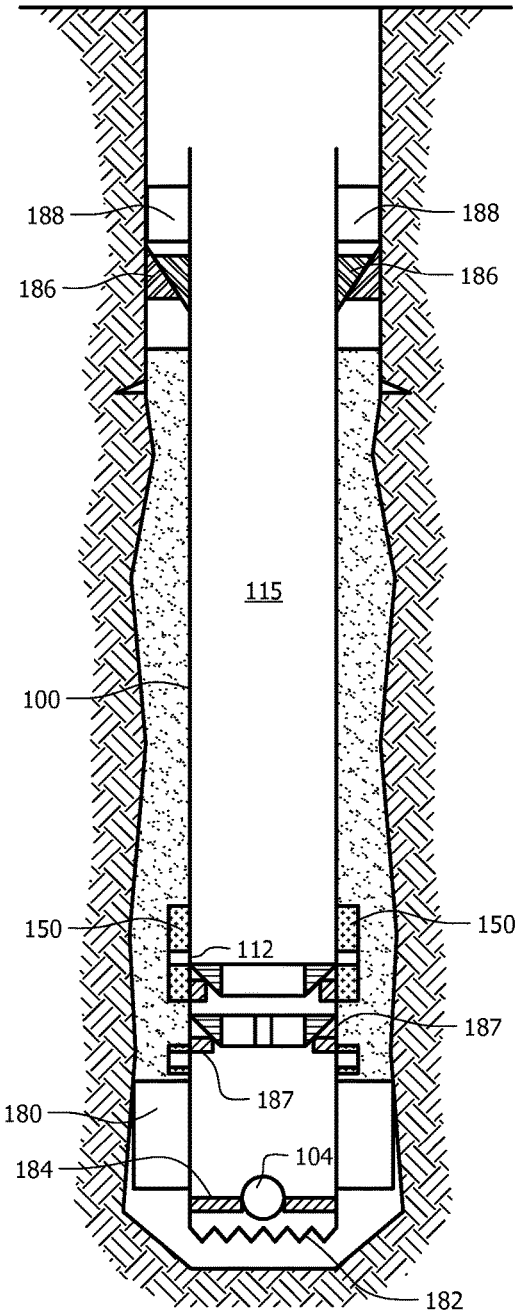

Once cementing is complete, the port 112 may be closed as shown in FIG. 1F. For example, a tail pump down plug might be pumped down the bore behind the cement. The tail pump down plug might then land in the tail liner wiper plug and shear it loose. Continued pressure would then land the plugs in a corresponding plug sleeve in the port collar/swivel 150, while closing the port 112 (for example, by shearing an interior sleeve and driving it down to cover the port). Thus, in FIG. 1F, the port 112 would be closed so cement cannot flow back into the bore 115, and the bore may have been wiped out so that it is substantially free of cement. Then in FIG. 1G, a liner top packer 188 (e.g. a packer for sealing the annulus which is located near the top of the liner) might optionally be set to isolate the top of the liner and/or hold the liner in place while the cement hardens. At this point, the liner 100 would be cemented in place (as shown in FIG. 1H), and the tool string/drill pipe might be removed/uncoupled from the top of the liner. With the cemented liner in place, another drilling operation (for example, similar to that described herein) might then be performed for the next section of liner/casing. So for example, to drill the next section the wiper plug(s) and/or interior sleeve might be drilled out when the next section of the well is drilled (to allow the drill to proceed downhole deeper than the initial liner). Such exemplary liner drill-in operations might be performed using one or more embodiments of the port collar tool described herein. For example, the disclosed embodiments set forth below may provide additional details regarding operation of exemplary tools of the sort which might be used for such liner drill-in operations shown in FIGS. 1A-H (for example, with the exemplary tools of FIGS. 2-3 being used to implement the method/process described above).

Disclosed embodiments of a drilling port collar tool typically might comprise a sealing port collar element for interaction with a port in the liner (for allowing fluid communication from the bore of the liner to the annular space between the liner and the sidewalls of the hole) which has at least two configurations. In the first configuration, the sealing collar closes/seals the port and the port collar element acts as an engaged spline joint (e.g. preventing rotation of an upper portion of the liner with respect to a lower portion of the liner so that the liner acts rotationally as a solid whole unit capable, during drilling, of transmitting torque down the tool string to the drill bit typically located at the bottom of the liner). In the second configuration, the collar would open the port (e.g. cease to close/seal the port), and the port collar element might be capable of rotating or act as a swivel joint (e.g. with a disengaged spline joint allowing free rotation of the upper portion of the liner with respect to the lower portion of the liner). So in the first configuration, the tool would not allow fluid communication from the bore of the liner to the annulus, and would not allow rotation within the liner/tool (e.g. the liner would rotate as a whole, typically based on rotation of the entire tool string from the surface); in the second configuration, the tool would allow fluid communication from the bore of the liner to the annulus (through one or more port in the liner), and would allow rotation of the tool (e.g. acting as a swivel joint so that the upper portion of the liner might rotate with respect to the lower portion of the liner). And in some embodiments, the tool might also (optionally) have a third configuration, in which the tool reseals the port (for example, while still allowing rotation in the tool). Thus, the tool may be selectively activated between configurations (for example, transitioning the tool from the first (initial) configuration (e.g. during drilling), to the second configuration (during cementing), and finally (optionally) to the third configuration (once cementing is complete)).

Stated another way, disclosed tool embodiments might comprise a port collar element that includes a sealing collar (for interaction with the port in the liner) having an open and closed position, and a joint (such as a spline joint or selective swivel point/joint) that may selectively be rotationally locked or unlocked (to allow rotation or swiveling). Typically, the joint would be coupled to the sealing collar in such a way that de-activation of the sealing collar (to open the port) would operate to selectively unlock the joint/swivel point (to allow rotation). And oftentimes, the tool would also include a means to re-close or reseal the port (for example an interior sleeve operable to close the port(s) in the liner).

Disclosed embodiments typically might operate as a hydraulically operated tool. So for example, sufficient hydraulic pressure in the bore of the liner might operate to shift the port collar element (typically downward), thereby opening the port (by shifting the sealing collar so that it no longer blocks/covers the port) to allow fluid communication from the bore to the annulus. The shifting of the port collar element might also act to disengage a spline joint (e.g. selectively activating a swivel joint/point), thereby allowing rotation. This might allow for the upper portion of the liner/tool (above the swivel point) to rotate during cementing (as cement is pumped downhole through the bore of the liner and out into the annulus via the one or more ports), even while the lower portion of the liner/tool is held securely in place in the hole by the packer. Typically, the upper portion of the liner/tool might be rotated via the tool string from the surface. Tension and/or compression rotational bearings may be incorporated into the port collar element in some embodiments, to facilitate lower-torsion rotation as the liner is in a tension or compression state at the port collar element. Additionally, some embodiments might also incorporate a spring-loaded piston valve, which may allow the valve to close if insufficient hydraulic pressure is applied in the bore of the liner (which may, for example, prevent cement from u-tubing back into the liner after it has been displaced into the annulus due to an imbalance in the hydrostatic heads between the liner and the annulus).

Figure 2A:
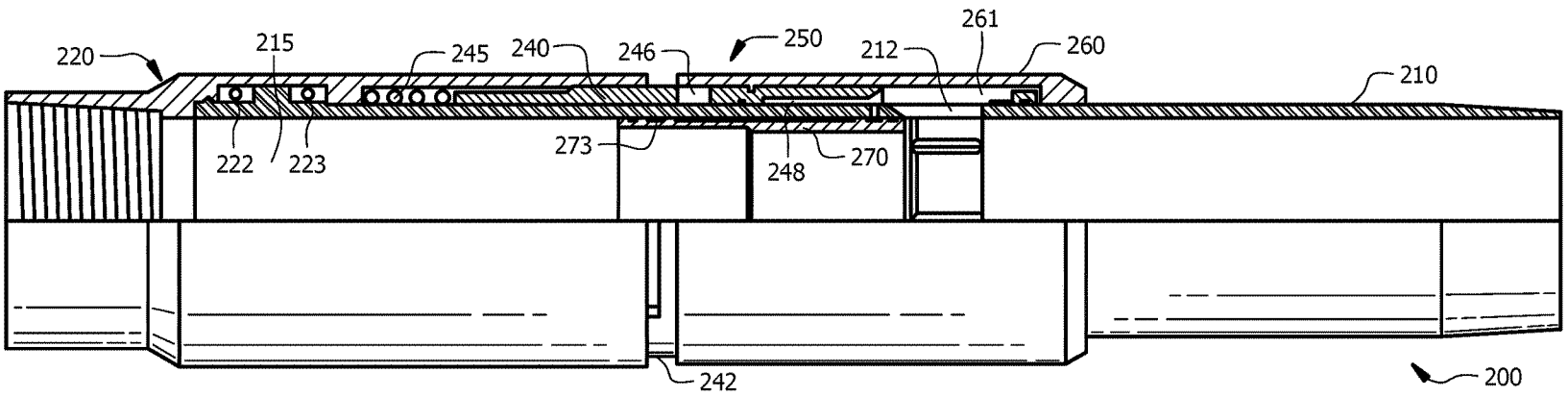
FIGS. 2A-C illustrate an exemplary port collar tool in three different configurations, with FIG. 2A showing in partial cut-away side view the first configuration for drilling (and FIG. 2A1 showing a cross-section), FIG. 2B showing in partial cut-away side view a second configuration for cementing (and FIG. 2B1 showing a cross-section), and FIG. 2C showing in partial cut-away side view a third configuration (after cementing is complete and the port is sealed)
Figure 2B:
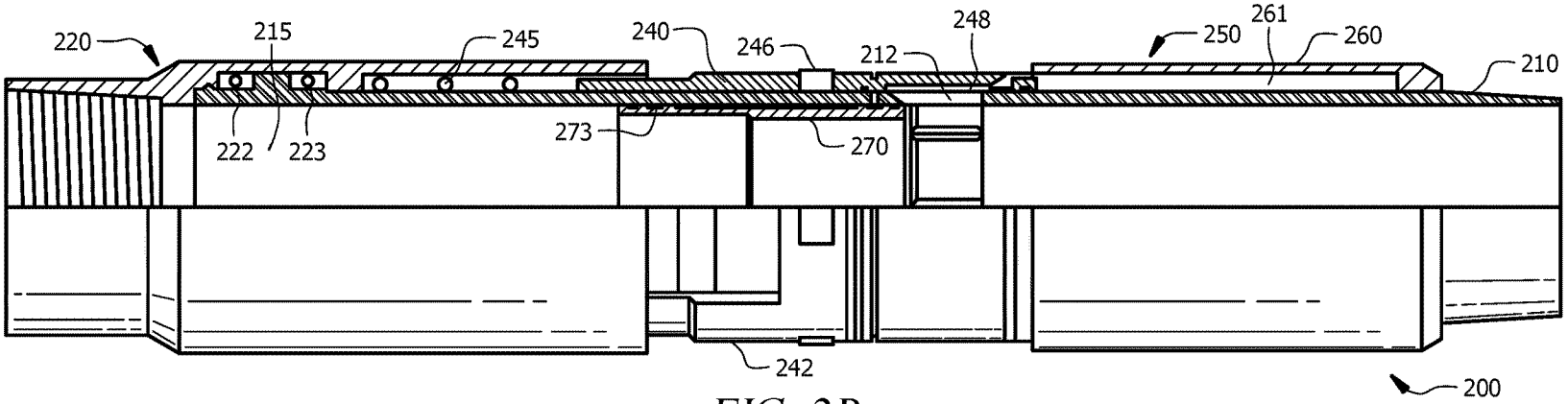
Figure 2C:
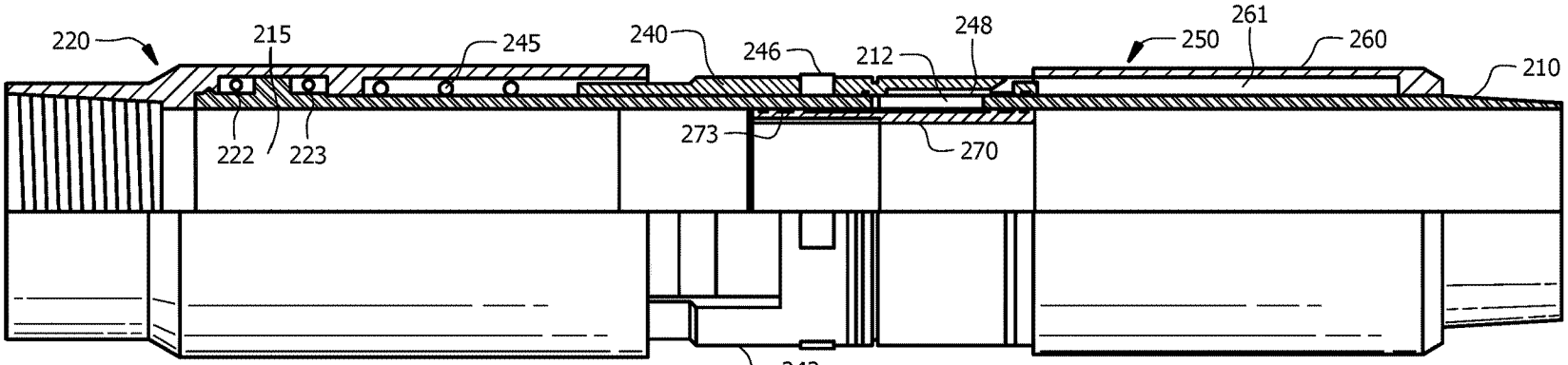

FIGS. 2A-2C illustrate an exemplary tool embodiment 200, with FIG. 2A showing the tool in a first configuration (for example, for drilling, with the spline joint engaged to prevent rotation and the port closed), FIG. 2B showing the tool in a second configuration (for example, for cementing, with the port ready to open under fluid pressure and the spline joint disengaged to allow rotation), and FIG. 2C showing the tool in a third configuration (for example, after cementing is completed and in preparation for further drilling deeper downhole, with the port closed (even though the spline joint may remain disengaged)). Typically, the tool 200 of FIG. 2 may be hydraulically operated, with hydraulic pressure in the bore of the liner transitioning the tool from the first configuration to the second configuration, and from the second configuration to the third configuration (for example, using another hydraulically-driven element in the bore). In other embodiments, the tool may be configured to be operated using alternate means (such as battery operated motors using a time-delay mechanism, dissolvable material triggers coupled with spring-loaded components, etc., for example).

Turning now to FIG. 2A in more detail, the tool 200 is formed in a liner 201, having a longitudinal bore 215 and at least one port/opening 212 (operable to provide fluid communication from the bore to the annulus outside the liner when the port is open/unsealed). In FIG. 2A, the liner 201 includes an upper housing body 220 and a lower housing body 210, and the at least one port/opening 212 is located in the lower housing body 210. In FIG. 2A, the lower housing body 210 is longitudinally coupled (in a sealing manner) at its upper end to the upper housing body 220 (so that the housings provide a continuous longitudinal bore 215 and may not shift longitudinally with respect to one another but might be operable to rotate/swivel with respect to one another, depending on whether the spline joint is engaged or not as discussed below). Tension 223 and/or compression 222 rotational bearings may be incorporated at this coupling in some embodiments, to facilitate lower-torsion rotation whenever the liner is in a tension or compression state. The tool 200 also includes a port collar element 250 which is located around the exterior of the lower housing body 210 and at least partially within/inside the upper housing body 220 (with at least a portion of the port collar element 250 located between the lower housing body 210 and the upper housing body 220).

In FIG. 2A, the port collar element 250 comprises a spline joint 240 and a sealing collar 260. The spline joint 240 of FIG. 2A is operable to interact with the upper housing body 220 (for example, the splines 242 of the spline joint interacting with corresponding splines in the upper housing body 220) so that when the spline joint is engaged (with the splines 242 of the spline joint intermeshing (radially) with the splines of the upper housing body 220—see for example FIG. 2A1), the spline joint 240 is locked and prevents rotation of the upper housing body 220 with respect to the lower housing body 210. FIG. 2A (and its related cross-section FIG. 2A1) shows the spline joint 240 when it is engaged to prevent rotation. The spline joint 240, however, is also operable to disengage from the upper housing body 220 (for example by sliding downward so that the splines 242 no longer interact rotationally with the splines of the upper housing body 220, but have rotational clearance—see for example FIG. 2B1), to allow rotation of the upper housing body 220 with respect to the lower housing body 210 (as shown in FIG. 2B, for example). Additionally, in FIG. 2A, the port collar element 250 (e.g. the spline joint 240) is biased downward, for example by a spring or other biasing member 245. The sealing collar 260 of FIG. 2A is operable to interact with the port/opening 212 in the liner (to either open or close the port). FIG. 2A shows the sealing collar 260 closing/sealing the port/opening 212 (e.g. positioned to cover/close/seal the port), while FIG. 2B shows the sealing collar 260 positioned to open the port/opening 212 (e.g. positioned to no longer close/cover/seal the port).

So in the first configuration, shown in FIG. 2A, the port collar element 250 may be removably/releasably held in longitudinal position with respect to the liner—e.g. the upper housing body 220 and/or the lower housing body 210 (for example, by one or more shearing element, such as a shear pin or shear screw or other means for releasably holding the longitudinal position of the port collar element). For example, in FIG. 2A the sealing collar 260 might be removably/releasably held in longitudinal position (in its first/closed position) with respect to the lower housing body 210 by one or more shearing elements. The port collar element 250 in the first configuration shown in FIG. 2A (and the related cross-section shown in FIG. 2A1) would be located/positioned so that the sealing collar 260 closes/seals the one or more port/opening 212 in the lower housing body 210 (for example by covering the port/opening 212). Additionally (when the sealing collar is positioned in the first configuration to close the port), the spline joint 240 would be engaged/locked to prevent rotation (for example, with the splines 242 intermeshing with corresponding splines on the interior of the upper housing body 220 to prevent rotation of the upper housing with respect to the lower housing). In some embodiments, the sealing collar 260 and the spline joint 240 might also be removably/releasably coupled together in FIG. 2A (for example, by one or more shearing element, such as a shear pin or shear screw). In the embodiment shown in FIG. 2A, however, the sealing collar 260 and the spline joint 240 interact together and with respect to the lower housing body 210 via one or more radially sliding locking dog segments 246 (typically biased outward with spline joint longitudinal motion, but engaging with corresponding groove in the lower housing body 210 to provide interference that may prevent longitudinal sliding of the spline joint with respect to the lower housing body in the first configuration). So in FIG. 2A, the spline joint 240 may be operable to interact with the lower housing body 210, for example via locking dog segment(s) 246 which may interface with the corresponding groove in the outside of the lower housing body to releasably fix the position of the spline joint. The sealing collar 260 in its initial position (typically held removably in position by shearing elements) as shown in FIG. 2A may radially cover the locking dog segments, to prevent their movement radially outward (which in turn prevents the spline joint from disengaging with the lower housing body), thereby restraining the spline joint in its engaged/locked position and resisting the biasing effect of the spring to fix the spline joint with respect to the upper and lower housing. FIG. 2A also shows an interior sleeve 270 located/configured so that it does not block the port/opening 212 (e.g. in its first position/configuration). This interior sleeve 270 might be optional in some embodiments, but would typically be located within the bore 215 and have two configurations: a first configuration above the port and not closing the port, and second configuration over/closing/sealing the port. In some embodiments, the interior sleeve 270 might be releasably/removably held in its initial position, for example by one or more shearing elements. So, in FIG. 2A the tool 200 is configured for drilling, with the port/opening 212 closed (by the sealing collar 260 covering the port/opening 212, so that there would be no fluid communication from the bore 215 of the liner to the annulus) and the spline joint 240 engaged/locked (to prevent rotation, thereby allowing drilling torque to be transmitted throughout the tool string down to a drill bit located at the bottom of the liner).

FIG. 2B (and the related cross-section shown in FIG. 2B1) illustrates the tool 200 in its second configuration (after drilling, in preparation for cementing). In FIG. 2B, the port collar element 250 has shifted/slid downward to disengage the spline joint 240 (thereby allowing rotation of the upper housing body 220 with respect to the lower housing body 210) and to open the port/opening 212 (to allow fluid communication from the bore 215 to the exterior/annulus). More specifically, the spline joint 240 has shifted downward with respect to the upper housing body 220, thereby disengaging the splines 242 rotationally (with longitudinal clearance, for example) from the corresponding splines on the upper housing body, so that the spline joint now is free to swivel/rotate (since the splines no longer have rotational interference—see FIG. 2B1 for example); and the sealing collar 260 has shifted downward with respect to the lower housing body so that it no longer seals/covers the port/opening 212. Thus, in the second configuration shown in FIG. 2B, fluid flow through the bore 215 would be operable to exit through the port/opening 212 and flow into the annulus. Additionally, the upper housing body 220 in FIG. 2B would be operable to rotate/swivel with respect to the lower housing body 210 (for example if the lower housing body is held in place by a packer, the upper housing body might be rotated from the surface via the tool string). So in the configuration of FIG. 2B, the tool 200 is ready for cementing, in which cement may be pumped down the bore 215, through the port/opening 212, out to the annulus, all while the upper housing body 220 of the liner/tool is rotated (to provide better cement distribution around the liner in the hole).

The tool 200 of FIG. 2 typically may be hydraulically operable, such that the tool may be shifted from the first configuration of FIG. 2A to the second configuration of FIG. 2B by application of hydraulic/fluid pressure in the bore of the liner. This hydraulic operation of the tool 200 may be possible due to the use of shearing elements (such as shear pins or screws, for example, possibly in conjunction with radially sliding locking dog segments). For example as described above with respect to FIG. 2A, the port collar element 250 may be removably held in its first configuration (longitudinal position) by one or more shearing elements that fix the position of the port collar element 250 with respect to the upper housing body 220 and/or lower housing body 210. For example, in the embodiment of FIG. 2A, the sealing collar 260 may be removably held in its first/closed position by one or more shearing elements that fix its position with respect to the lower housing body 210. In this position, the sealing collar 260 extends to cover the locking dog segments 246 in the spline joint 240 (which are typically biased outward, but which in FIG. 2A are held in an engaged position (by the position of the sealing collar 260) interacting with corresponding groove on the exterior of the lower housing body 210 to releasably fix (via longitudinal interference) the longitudinal position of the spline joint 240 with respect to the lower housing body 210 and thereby with respect to the upper housing body 220). Application of sufficient (e.g. activation) pressure (via fluid in the bore 215) may overcome the shearing elements (e.g. overcome the retaining force to shear the shearing elements), thereby allowing the port collar element 250 to slide/shift downward under application of the pressure (typically until it engages a retaining feature, such as a shoulder). In more detail, FIG. 2A shows an exemplary sealing collar 260 which is shaped/configured so that, even when closed/positioned over the port/opening 212, fluid from the bore 215 may enter a chamber 261 in the sealing collar 260. The pressure of such fluid entering the chamber 261 in the sealing collar 260 may act downward on the sealing collar 260, shearing the shearing elements and driving the sealing collar 260 downward like a piston. The downward movement of the sealing collar 260 might then uncover the locking dog segments 246 in the spline joint, thereby unlocking the spline joint 240 from the lower housing body 210 and allowing the spline joint to disengage (for example, under biasing force as provided by spring 245 in FIG. 2A, moving into the second configuration as shown in FIG. 2B (e.g. with splines no longer interlocking, but rather disengaged to allow rotational movement of the spline joint 240)). In some embodiments, the spring biasing member 245 may also assist in shearing the shearing elements (in conjunction with the fluid pressure). And in some embodiments, the spring biasing member 245 may allow the spline joint 240 to act as a spring-loaded piston valve, such that the valve may be operable to close if insufficient hydraulic pressure is applied in the bore 215. Thus, the port collar element 250 may be hydraulically activated via sufficient fluid pressure in the bore 215, in order to shift/slide the sealing collar 260 downward (to open the port/opening 212) and to disengage the spline joint 240 (to allow rotation), thereby reconfiguring the tool 200 from the (first) configuration of FIG. 2A to the (second) configuration of FIG. 2B.

In FIG. 2B, the sealing collar 260 may also disengage/uncouple longitudinally from the spline joint 240, allowing the sealing collar 260 to shift further downward than does the spline joint. The spline joint 240 shifts/slides downward to disengage/unlock (e.g. with splines 242 of the spline joint no longer in rotational interference with splines in the upper housing body 220), and the sealing collar 260 shifts/slides further downward to clear the port/opening 212 (thereby opening the port). In some embodiments, the spline joint may include an aperture operable to align with the port/opening 212 to allow fluid flow out to the annulus. In embodiments in which the sealing collar 260 disengages from the spline joint 240 (as shown in FIG. 2B, for example), the sealing collar 260 typically would be coupled to the lower housing body by one or more shearing elements, and the spline joint would typically be removably coupled to the lower housing body, for example by one or more locking dog segments. Sufficient (e.g. activation) pressure in the bore 215 would operate to shear the shearing elements, allowing the sealing collar 260 to shift downward with respect to the lower housing body 210 (to allow fluid flow from the bore 215, out the port 212, to the annulus), with the sliding of the sealing collar 260 then allowing the spline joint 240 to shift downward with respect to the upper housing body 220 (to disengage/unlock to allow rotation). In some embodiments, the spline joint might be driven (for example by the spring or biasing member 245) into contact with a lower retaining element (such as a shoulder). In some embodiments, the biasing force acting on the spline joint (for example spring or biasing member 245) would act to close the port/opening 212 in the absence of sufficient fluid pressure in the bore 215 (for example, to prevent u-tubing of cement back into the liner due to an imbalance in hydrostatic pressure between the liner and the annulus). Under sufficient fluid pressure in the bore 215, however, the pressure would act on the spline joint 240 to drive/shift the spline joint slightly upward (not enough to re-engage the splines, but enough to open the fluid flow from the bore to the annulus). For example, this might be accomplished by the design/configuration of the lower portion of the spline joint, which might include a recess 248 or cavity into which fluid might flow (from the port) such that pressure therein would shift the spline joint 240 upward to open the port completely to allow fluid communication from the bore 215 to the annular space between the tool 200 and the walls of the wellbore. The sealing collar might also be driven downward (for example by the fluid pressure entering its chamber 261) until it contacts a lower retaining feature (for example, a shoulder, or an element attached below the lower housing body 210 and having a larger outer diameter).

In FIG. 2C (showing the third configuration, once cementing is complete), the interior sleeve 270 is shifted downward within the bore 215 of the lower housing body 210 to close/cover/seal the port/opening 212 (in other words, FIG. 2C is merely FIG. 2B once the interior sleeve 270 has been shifted to close the port/opening 212). Typically, the interior sleeve of FIG. 2C would be hydraulically shifted downward. So for example, the interior sleeve 270 might be removably/releasably held in its open/initial position as shown in FIGS. 2A-B (for example by shearing elements). Once cementing is completed, a plug might then be hydraulically pumped downhole in the bore 215. The plug/wiper would typically be sized and shaped to engage the interior sleeve 270, such that hydraulic pressure in the bore might then be used to shear the shearing elements and shift the interior sleeve 270 downward into its closed/second position (covering/sealing the port/opening 212). Typically, the interior sleeve 270 might shift downward until it locks into its closed position. For example, the interior sleeve 270 might comprise a c-ring 273 on its exterior which is biased outward. Once the interior sleeve is positioned to re-close the port, the c-ring 273 would engage a corresponding groove in the inner face/surface of the lower housing body 210, snapping into place to lock the longitudinal position of the interior sleeve 270 with respect to the lower housing body 210 (in a closed position, sealing the port).

Figure 3A:
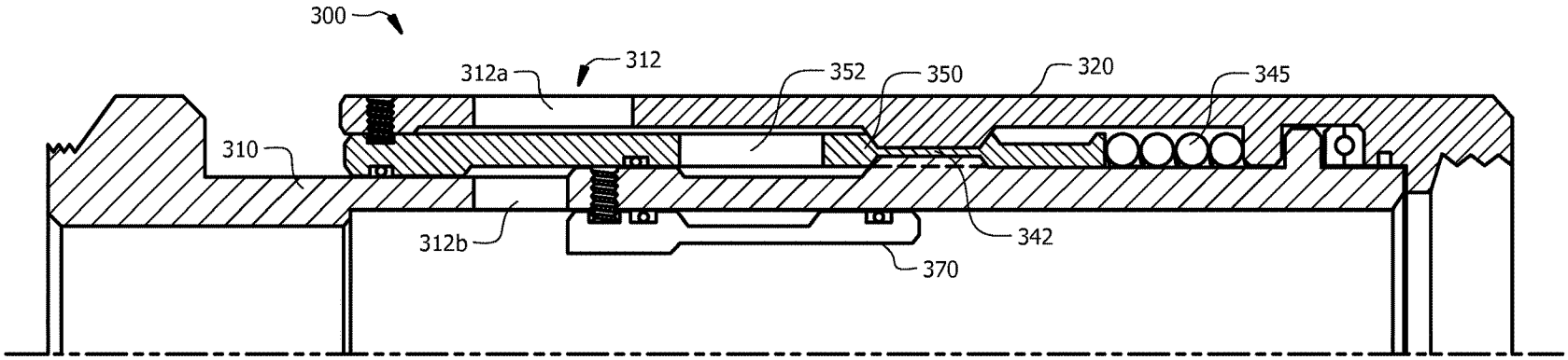
FIGS. 3A-B illustrate cut-away side views of a similar alternative tool, showing both the drilling position/configuration in FIG. 3A and the cementing position/configuration in FIG. 3B.
Figure 3B:
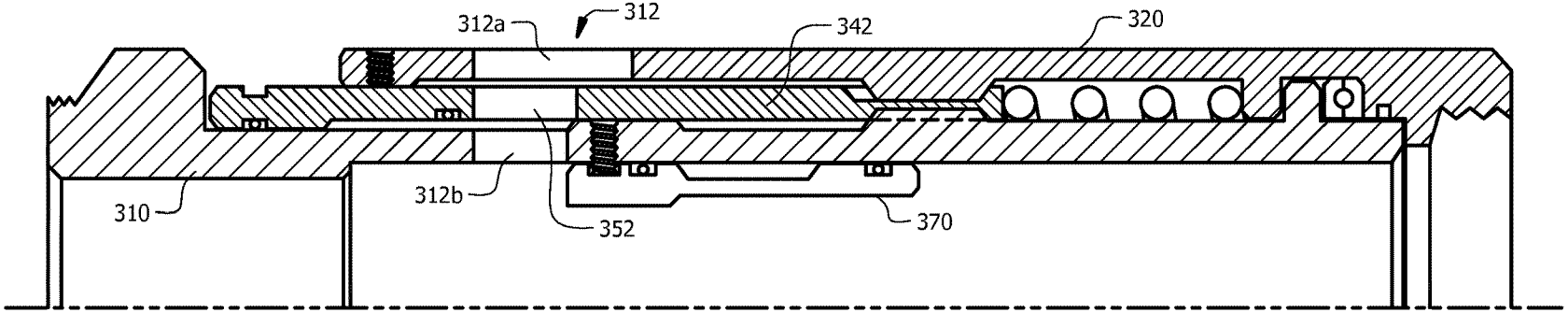

FIGS. 3A-3B illustrate another, similar (e.g. alternate) hydraulic tool embodiment. In the tool 300 of FIGS. 3A-3B, the sealing sleeve 350 typically would have an aperture 352 in it, so that the port 312 may be opened by aligning the aperture 352 in the sealing sleeve with the port 312 (and the port would be closed when the aperture is not aligned with the port). And in some embodiments, the port 312 in the liner may be formed of an inner port 312*b* (for example in the lower liner housing 310) and an outer port 312*a* (for example in the upper liner housing 320). In such embodiments, the port 312 would be opened by aligning the aperture 352 in the sealing sleeve 350 with the one or more port elements 312*a,b*. And as discussed above, the action of opening the port 312 (by shifting the sealing sleeve 350 downward to align the aperture 352 with the port 312) would also disengage the spline joint (e.g. splines 342) of the sealing sleeve from interaction with the upper liner housing 320 (which would have corresponding splines) to allow rotation of the upper liner housing 320 with respect to the lower liner housing 310 (which typically might be fixed in the hole by the packer). Finally, the tool 300 of FIGS. 3A-3B may have (optionally) a closing/interior sleeve 370, which is operable to slide/shift downward (typically under hydraulic pressure with a plug being pumped downward in the liner bore to engage the closing sleeve) to re-close/re-seal the port. FIG. 3A shows this tool embodiment in the first configuration (e.g. with the port closed and the spline joint engaged or radially locked—for example for drilling), while FIG. 3B shows the tool embodiment in the second configuration (e.g. with the port open to allow fluid communication between the bore 315 and the annular space outside the tool housing, and the spline joint disengaged (e.g. radially unlocked) to allow rotation of the upper housing with respect to the lower housing—for example for cementing). In operation, this embodiment of FIGS. 3A-3B would be quite similar to that of FIGS. 2A-2B, except FIGS. 3A-3B uses a single element as the spline joint and the sealing sleeve (which may require an aperture 352 appropriately located/configured to move between two positions for interaction with the port (e.g. to close and open the port)).

Having described above various product and method/process embodiments (especially those shown in the figures), various additional embodiment may include, but are not limited to the following:

In a first embodiment, a tool/tool string comprising: a liner comprising a lower housing body and an upper housing body (with the upper housing body (sealingly) coupled to the lower housing body and a portion of the upper housing body located about a portion of the lower housing body), the liner having a longitudinal bore therethrough; a port/opening in a sidewall of the lower housing, allowing fluid communication from the bore to the exterior of the liner/tool (e.g. the annular space about the liner when the liner is downhole); and a port collar element, comprising: a spline joint (or splines operable to form a spline joint when interacting with corresponding splines in the upper housing body), and a sealing collar located about the lower housing body; wherein: the upper housing body and lower housing body are attached/coupled in sealing engagement to provide the continuous longitudinal bore through the liner for continuous fluid flow, and wherein such attachment prevents longitudinal movement (of the lower housing body with respect to the upper housing body) but allows rotational movement of the lower housing body with respect to the upper housing body; the port collar element is operable, in the absence of sufficient hydraulic/fluid pressure (e.g. absence of activation pressure) in the bore (e.g. in its first configuration), to have the spline joint engaged (thereby preventing rotation of the lower housing body with respect to the upper housing body) and to seal/cover/close the port (e.g. with the sealing collar covering the port); and the port collar element is operable, in the presence of sufficient hydraulic/fluid pressure (e.g. presence of activation pressure) in the bore (e.g. in its second configuration), to disengage the spline joint (thereby allowing rotation/swiveling of the lower housing body with respect to the upper housing body) and to open the port (e.g. with the sealing collar no longer covering the port) (thereby allowing fluid flow/communication from the bore to the exterior/annulus) (for example by downward motion/displacement of the sealing sleeve with respect to the port). In a second embodiment, the tool of the first embodiment further comprising an internal sleeve removably/releasably held in place in the bore above the port (e.g. removably attached in such a way as to allow hydraulic activation of the interior sleeve to close/seal the port), but operable under engaging force/pressure (for example, a ball or seal driven downward by fluid pressure in the bore) to shift downward to seal the port. In a third embodiment, the tool of embodiments 1-2 wherein the port collar element is initially releasably held (in a manner allowing for hydraulic activation via fluid pressure in the bore) in a closed position or first configuration (covering the port) (for example by one or more shearing elements, such as shear pins or screws). In a fourth embodiment, the tool of embodiments 1-3 wherein the spline joint is initially releasably held (in a manner allowing for hydraulic activation via fluid in the bore) in an engaged/locked position (or in its first configuration). In a fifth embodiment, the tool of embodiments 3-4 wherein, under sufficient activation pressure (e.g. pressure reaches activation level) in the bore, the sealing collar is operable to slide/shift downward, for example clear of the port (e.g. to slide downward so that the entire sealing sleeve is below the port) (thereby opening the port to allow fluid communication from the bore to the exterior/annulus). In a sixth embodiment, the tool of embodiments 3-4 wherein the sealing collar comprises an aperture, and is operable, under sufficient activation pressure (e.g. pressure reaches activation level) in the bore, to slide/shift to align the aperture with the port (thereby opening the port and allowing fluid communication from the bore to the exterior/annulus—and typically in such embodiments, the sealing collar and spline joint might be rigidly attached into an integral whole, for example with splines fixed onto the sealing sleeve). In a seventh embodiment, the tool of embodiments 1-6 wherein the spline joint is biased downward (for example by a spring element, which would provide sufficient force to position the spline joint in its second configuration (e.g. with splines disengaged), which might position the spline joint to close the port in the absence of sufficient fluid pressure in the bore, and which would position the spline joint in the presence of sufficient fluid pressure in the bore to open the port and allow fluid flow through the port (while ensuring that the splines do not re-engage)). In an eighth embodiment, the tool of embodiments 1-7 wherein the spline joint comprises a plurality of splines (for engagement with corresponding splines on the upper housing, for example), which create rotational interference when engaged (to prevent rotation), but which have sufficient (longitudinal) clearance when disengaged to allow rotation. In a ninth embodiment, the tool of embodiments 1-8 wherein initially (in a first configuration), the spline joint is engaged and the port collar element covers/closes the port (and is releasably attached to the lower housing body). In a tenth embodiment, the tool of embodiments 1-9 wherein in the second configuration (e.g. after application of an activation level of hydraulic pressure in the bore), the spline joint is disengaged and the port collar element does not cover the port (e.g. the port is open). In an eleventh embodiment, the tool of embodiments 1-10 wherein an upper end of the upper housing body is configured for (selectively releasable) attachment to a tool string. In a twelfth embodiment, the tool of embodiments 1-11 further comprising an open hole packer located on the exterior of the lower housing body. In a thirteenth embodiment, the tool of embodiments 1-12 further comprising a (selectively hydraulically activated, e.g. by sufficient activation pressure in the bore) liner hanger on the exterior of the upper housing body operable upon activation to hold/secure (the (longitudinal) location of) the upper housing body within the wellbore (e.g. by wedging against the wellbore).

In a fourteenth embodiment, a tool for use placing a liner (having a longitudinal bore therethrough and a port in a sidewall allowing fluid communication from the bore to the exterior/annulus) downhole, comprising: a hydraulically operated port collar (operable to initially close the port (and remain closed when there is insufficient activation pressure in the bore) and, under sufficient hydraulic pressure in the bore, to open the port); and a selective swivel point/spline joint (operable to selectively allow rotation and fix rotation (for example of a lower housing body of the liner with respect to an upper housing body of the liner)); wherein the swivel point is selectively activated (e.g. spline joint disengaged to allow rotation of the upper housing with respect to the lower housing) by activation/opening of the port collar. In a fifteenth embodiment, the tool of embodiment 14 wherein the port collar is operable to open when sufficient pressure is applied in the bore (thereby opening the port to allow fluid communication from the bore to the exterior/annulus). In a sixteenth embodiment, the tool of embodiments 14-15 wherein the port collar opens by shifting/sliding with respect to the port in the liner. In a seventeenth embodiment, the tool of embodiment 16 wherein sliding/shifting of the port collar activates the swivel point (e.g. disengages the spline joint) to allow rotation, and wherein prior to activation the swivel point is rotationally locked (e.g. with splines of the spline joint extending to mesh with corresponding spline on the liner (e.g. upper housing body) to provide rotational interference). In an eighteenth embodiment, the tool of embodiments 14-17 further comprising a means to selectively re-close the port (for example, an interior sleeve, which might be initially located above the port but operable to shift downward to re-seal/re-close the port, for example under sufficient pressure in the bore and/or a ball/plug (e.g. hydraulically operated)).

In a nineteenth embodiment, a tool comprising a port collar element for use with a liner (having a longitudinal bore therethrough); wherein the port collar element comprises a sealing collar (operable to selectively open or close a port in the liner) and a spline joint/swivel point (operable to selectively lock or allow rotation); wherein the sealing collar is coupled to/interacts with the spline joint (so that selective activation/opening of the sealing collar would in turn activate/disengage the spline joint to allow rotation); and wherein the port collar element has two configurations, with the first (initial) configuration having the sealing collar closing/sealing the port and the spline joint engaged to prevent rotation; and the second configuration having the sealing collar positioned to open the port (allowing fluid communication from the bore externally to the annulus) and the spline joint disengaged (and acting as a swivel joint) to allow rotation. In a twentieth embodiment, the tool of embodiment 19 wherein the port collar element is operable to hydraulically shift from the first configuration to the second configuration (such that sufficient/activation hydraulic pressure in the bore of the liner hydraulically operates the port collar element, transitioning from its first configuration to its second configuration, for example by shifting the sealing collar downward to open the port, thereby disengaging the spline joint to allow rotation). In a twenty-first embodiment, the tool of embodiments 19-20, further comprising an interior sleeve (operable to selectively re-close the port in the liner, for example by shifting downward to cover/seal the port). In a twenty-second embodiment, the tool of embodiment 21, wherein the interior sleeve is initially releasably held in place above the port, such that the interior sleeve is operable to be activated (to re-close the port) by hydraulic pressure in the bore (for example, driving a ball or seal element into contact with the interior sleeve). In a twenty-third embodiment, the tool of embodiments 21-22, wherein activation (e.g. shifting) of the interior sleeve places the tool in a third configuration, with the port permanently sealed.

In a twenty-fourth embodiment, a downhole tool comprising: an upper housing body; a lower housing body (with the upper housing body (sealingly) coupled to the lower housing body and a portion of the upper housing body located about a portion of the lower housing body), wherein the upper and lower housing bodies (jointly) have a continuous longitudinal bore therethrough; a port located in sidewall of) either the lower or upper housing (providing an opening passing through the sidewall operable to allow fluid flow/communication from the bore to an exterior of the housing bodies) (and typically the port might be located in the lower housing body); and a port collar element having two configurations; wherein in the initial (first) configuration, the port collar element is operable to seal/cover/close (e.g. be positioned over) the port and to prevent rotation of the lower housing body with respect to the upper housing body (e.g. e.g. due to engagement of splines in the port collar element with corresponding splines in the upper housing body); and wherein in the second (selectively activated) configuration (e.g. after application of activation pressure within the bore), the port collar element is operable to not cover/seal/close (e.g. not be positioned over) the port (e.g. open the port) and to allow rotation of the lower housing body with respect to the upper housing body (e.g. due to disengagement of the splines in the port collar element with the corresponding splines in the upper housing body). In a twenty-fifth embodiment, the tool of embodiment 24 wherein the port collar is operable to be hydraulically activated from its first configuration to its second configuration (e.g. by (sufficient activation) fluid pressure in the bore—for example after the bottom of the bore has been sealed/closed). In a twenty-sixth embodiment, the tool of embodiments 24-25 wherein the port collar element is located at least partially about/around the lower housing body and at least partially within the upper housing body. In a twenty-seventh embodiment, the tool of embodiments 24-26 wherein the port collar element comprises a sealing sleeve and a spline joint element (and wherein prior to activation, the port collar element is releasably held in its first configuration). In a twenty-eighth embodiment, the tool of embodiment 27 wherein the sealing sleeve comprises a chamber configured so, when the port collar element is in its first configuration, pressure from the bore enters the chamber, and when pressure in the chamber reaches an activation level, the sealing sleeve is driven/shifted downward (or otherwise longitudinally away from/clear of the port) (to its second (open) configuration) by hydraulic pressure (e.g. which overcomes/shears a releasable holding means such as shearing pins or screws). In a twenty-ninth embodiment, the tool of embodiments 27-28 wherein the spline joint element comprises a recess operable/configured so that fluid pressure in the recess may drive/shift the spline joint element slightly upward (or otherwise longitudinally away from/clear of the port) when the port collar element is in its second configuration (e.g. to open the port fully to allow fluid communication from the bore to the exterior/annulus area) (but not far enough upward to re-engage the spline joint (e.g. not sufficient to rotationally lock the spline joint). In a thirtieth embodiment, the tool of embodiments 27-29 wherein, when the port collar element is in the second configuration, the sleeve does not cover the port (for example, when there is sufficient/activation fluid pressure in the bore). In a thirty-first embodiment, the tool of embodiments 27-30 wherein the spline joint element is released when the sealing sleeve moves/shifts (longitudinally, for example downward (into second configuration)) and moves/shifts (e.g. downward or otherwise longitudinally, for example away from corresponding splines in the housing body) to its second configuration (e.g. to unlock the splines (e.g. disengage the splines of the spline joint from corresponding splines in the housing body) to allow rotation of the upper housing body with respect to the lower housing body). In a thirty-second embodiment, the tool of embodiments 27-31 further comprising a biasing means/element (e.g. a spring) which biases the spline joint element downward within the upper housing (or alternatively, wherein the spline joint element is biased downward or otherwise longitudinally, for example away from engagement of the spline joint with corresponding splines in the housing within the upper housing body). In a thirty-third embodiment, the tool of claim 27-32 further comprising one or more locking dog elements (in or interacting with the spline joint element) operable to engage with a corresponding groove in the exterior of the lower housing body (e.g. to fix the longitudinal position of the spline joint element with respect to the lower and/or upper housing body in the first configuration) (and wherein in the first configuration of the port collar element, the locking dog element is releasably held in contact with the groove in the lower housing body by the sealing sleeve) (and wherein when the port collar element moves to its second configuration, the downward movement of the sealing sleeve releases the locking dog element (e.g. for outward movement) (from the groove) to allow the spline joint element to move/shift to its second (unlocked/disengaged) configuration. In a thirty-fourth embodiment, the tool of embodiments 24-33 further comprising an interior sleeve (located within the bore—e.g. along the interior surface of the housing), and having two (selectively activated—e.g. hydraulically activated) positions/configurations (with the first position/configuration located (e.g. releasably held) above the port and the second position/configuration (permanently) covering/sealing the port). In a thirty-fifth embodiment, the tool of embodiments 24-34 wherein the port collar element further comprises: an aperture, and a plurality of splines operable/configured to interact with corresponding splines in the upper housing (e.g. to rotationally fix/lock the position of the upper housing body with respect to the lower housing body) (or alternatively the sealing sleeve has an aperture and is rigidly attached to the spline joint to form an integral whole, for example with splines projecting out of the (top of the) sealing sleeve). In a thirty-sixth embodiment, the tool of embodiment 35 wherein, when the port collar element is in the first configuration, the aperture is out of alignment with the port (e.g. to close the port or prevent fluid flow therethrough); and wherein when the port collar element is in the second configuration, the aperture is aligned with the port (e.g. to open the port or allow fluid flow therethrough). In a thirty-seventh embodiment, the tool of embodiments 35-36 wherein the port comprises an inner port (e.g. in the lower housing) and an outer port (e.g. in the upper housing) (and wherein the inner and outer ports are aligned). In a thirty-eighth embodiment, the tool of embodiments 35-37 wherein the port collar element is located at least partially about/around the lower housing body and at least partially within the upper housing body. In a thirty-ninth embodiment, the tool of embodiments 24-38 further comprising an interior sleeve (located within the bore—e.g. along the interior surface of the housing), and having two (selectively activated—e.g. hydraulically activated) positions/configurations (with the first position/configuration located above the port and the second position/configuration covering/sealing the port). In a fortieth embodiment, the tool of embodiments 24-39 wherein an upper end of the upper housing is configured for (releasable) attachment to a tool string. In a forty-first embodiment, the tool of embodiments 24-40 further comprising an open hole packer on the exterior of the lower housing body. In a forty-second embodiment, the tool of embodiments 24-41 further comprising a (hydraulically activated) liner hanger on the exterior of the upper housing body (operable upon activation (for example due to activation pressure in the bore) to hold the upper housing body securely in place within the wellbore). Further embodiments might include a tool string comprising a tool as described in embodiments 1-42 above, and/or a tool/tool string/liner/port collar element as described in the specification and/or shown in the figures. Persons of skill will understand that several of these embodiments may be similar, such that descriptions attributed to a particular embodiment may also apply for other, similar embodiments.

Furthermore, additional method or process embodiments for cementing a liner in place within a wellbore may comprise one or more of the following steps: forming up a tool string comprising a liner with a bore and a port (e.g. passing from the bore through the liner sidewall to the exterior/annular space) and port collar (for interaction with a port in the liner and selective rotational locking) (wherein forming up may comprise releasably attaching a liner to a tool string); drilling the liner into place downhole (e.g. circulating mud down the bore of the tool string (including the liner), through the end of a drilling shoe bit (e.g. at the lower end of the lower housing of the liner), and back up the annulus (e.g. annular space between the liner and the hole sidewalls), for example while the tool is in its first configuration (e.g. the port collar would be closed (preventing fluid flow out through the port in the liner) and the spline joint would be engaged (preventing rotation and allowing torque to be transmitted to the drill bit for drilling)) (typically while the liner and tool string are rigidly attached to allow for torque transmission downhole to the drill bit); dropping/pumping a ball down the bore to seal the bore of the liner at or near its bottom (for example, by engaging in a sealing manner with a ball seat below the position of the port or the open hole packer on the liner); applying pressure (e.g. activation pressure) in the bore to set a liner hanger (e.g. a rotating type of liner hanger typically located on the exterior of the upper housing of the liner), activate the open hole packer to seal the annular space between the liner and the sidewalls of the hole towards the bottom of the liner), and hydraulically activate the port collar/swivel (e.g. into second configuration, to open the port in the liner to allow flow from the bore to the annulus and to disengage the spline joint (e.g. unlock the swivel) to allow swivel/rotation); circulating mud (e.g. down the bore, through the port, into the annulus) while rotating the liner (e.g. prior to cementing, to condition the hole); hydraulically placing a lead pump down plug in a corresponding plug seat (to seal the bore just below the port collar/swivel or port) (for example, the lead pump down plug might land in a lead liner wiper plug, which would then shear loose until the lead wiper plug lands in the plug seat—thereby wiping the bore and sealing the bore in closer proximity to the port (e.g. just beneath the port)); and circulating cement down the bore, through the open port, into the annulus, while rotating the liner; (otherwise) plugging the bore of the liner below the port and circulating cement down the bore, through the open port into the annulus, while rotating the liner (e.g. cementing the liner in the wellbore); wiping the bore (for example, hydraulically pumping a wiper element down the bore); re-closing the port (for example, hydraulically activating an interior sleeve to seal the port or using a tail pump down plug which might be pumped down the bore behind the cement, the tail pump down plug might then land in the tail liner wiper plug and shear it loose, and continued pressure would then land the plug in a corresponding plug sleeve/seat in the port collar, while closing the port (for example, by shearing an interior sleeve and driving it down to cover the port)); (otherwise) re-closing the port (for example, by hydraulically shearing/shifting an interior sleeve (e.g. by pumping a plug or ball downhole under pressure until it seats on the interior sleeve and then continuing to increase pressure in the bore until the interior sleeve (which may be releasably held above the port, for example by shearing pins or screws) shears and shifts downward) and driving it down to cover the port; setting a liner top packer (e.g. a packer for sealing the annulus which is located near the top of the liner, which might be hydraulically set by pressuring the bore to an activation level, which might be higher than the first activation pressure) to isolate the top of the liner and/or hold the liner in place while the cement hardens; removing/uncoupling the tool string/drill pipe from the top of the liner; commencing another (e.g. sequential and substantially similar) drilling/liner placement/cementing operation (for example, similar to that described herein) for the next/subsequent section of liner/casing (for example, drilling out the ball and/or wiper plug(s) and/or interior sleeve when the next section of the well is drilled (to allow the drill to proceed downhole deeper than the initial liner); and then running and operating the tool string with a second/subsequent liner element/tool similar to that described above (e.g. to drill (with circulating mud down through the drill bit), clean-out (by circulating mud through the port uphole above the packer), hydraulically operate the tool (e.g. open the port), cement circulation, close the port (hydraulically), etc. as described above)). Such exemplary liner drill-in operations might be performed using one or more embodiments of the port collar tool described above (e.g. figure embodiments and/or embodiment 1-42, with specific method steps relating to those tools being employed herein.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A downhole tool comprising:

an upper housing body;

a lower housing body coupled to the upper housing body, wherein the upper and lower housing bodies have a continuous longitudinal bore therethrough;

a port providing an opening from the bore to an exterior of the housing bodies; and a port collar element having two configurations;

wherein in the first configuration, the port collar element is operable to close the port and to prevent rotation of the lower housing body with respect to the upper housing body; wherein in the second configuration, the port collar element is operable to not close the port and to allow rotation of the lower housing body with respect to the upper housing body;

wherein the port collar element comprises a sealing sleeve and a spline joint element;

wherein the sealing sleeve comprises a chamber configured so, when the port collar element is in its first configuration, fluid pressure from the bore enters the chamber, and when fluid pressure in the chamber reaches an activation level, the sealing sleeve is driven longitudinally clear of the port by the fluid pressure; and wherein the spline joint element is configured to be released when the sealing sleeve moves longitudinally, with the spline joint element shifting longitudinally away from corresponding splines in the housing body to allow rotation of the upper housing body with respect to the lower housing body.

2. The tool of claim 1, wherein the port collar is operable to be hydraulically activated from its first configuration to its second configuration.

3. The tool of claim 2, wherein the port collar element is located at least partially about the lower housing body and at least partially within the upper housing body.

4. The tool of claim 1, wherein, prior to activation, the port collar element is releasably held in the first configuration.

5. The tool of claim 1, wherein the spline joint element comprises a recess configured so that fluid pressure in the recess may drive the spline joint element longitudinally clear of the port when the port collar element is in the second configuration.

6. The tool of claim 1, wherein, when the port collar element is in the second configuration, the sleeve does not cover the port.

7. The tool of claim 1, wherein the spline joint element is biased away from engagement of the spline joint element with the corresponding splines.

8. The tool of claim 1, further comprising one or more locking dog elements in the spline joint element operable to engage with a corresponding groove in the exterior of the lower housing body.

9. The tool of claim 1, further comprising an interior sleeve having two configurations, with the first configuration located above the port and the second configuration covering the port.

10. The tool of claim 1, wherein the port collar element further comprises:

an aperture, and a plurality of splines configured to interact with corresponding splines in the upper housing.

11. The tool of claim 10, wherein, when the port collar element is in the first configuration, the aperture is out of alignment with the port; and wherein when the port collar element is in the second configuration, the aperture is aligned with the port.

12. The tool of claim 11, wherein the port comprises an inner port and an outer port.

13. The tool of claim 11, further comprising an interior sleeve having two configurations, with the first configuration located above the port and the second configuration covering the port.

14. The tool of claim 10, wherein the port collar element is located at least partially about the lower housing body and at least partially within the upper housing body.

15. The tool of claim 1, wherein an upper end of the upper housing body is configured for attachment to a tool string.

16. The tool of claim 1, further comprising an open hole packer on the exterior of the lower housing body.

17. The tool of claim 1, further comprising a liner hanger on the exterior of the upper housing body.

18. A downhole tool comprising:

an upper housing body;

a lower housing body coupled to the upper housing body, wherein the upper and lower housing bodies have a continuous longitudinal bore therethrough;

a port providing an opening from the bore to an exterior of the housing bodies; and a port collar element having two configurations;

wherein in the first configuration, the port collar element is operable to close the port and to prevent rotation of the lower housing body with respect to the upper housing body; wherein in the second configuration, the port collar element is operable to not close the port and to allow rotation of the lower housing body with respect to the upper housing body;

wherein the port collar element comprises a sealing sleeve and a spline joint element;

wherein the sealing sleeve comprises a chamber configured so, when the port collar element is in its first configuration, fluid pressure from the bore enters the chamber, and when fluid pressure in the chamber reaches an activation level, the sealing sleeve is driven longitudinally clear of the port by the fluid pressure; and wherein the spline joint element comprises a recess configured so that fluid pressure in the recess may drive the spline joint element longitudinally clear of the port when the port collar element is in the second configuration.

* * * * *